US005310221A

United States Patent [19]

Schmidt

[11] Patent Number: 5,310,221

[45] Date of Patent: May 10, 1994

[54] PROTECTIVE CAP FOR SKI TIPS

[76] Inventor: Richard Schmidt, 18 Hacket Pl., Rutherford, N.J. 07070

[21] Appl. No.: 784,705

[22] Filed: Oct. 30, 1991

[51] Int. Cl.[5] ..... A62C 11/00

[52] U.S. Cl. ..... 280/809; 280/816

[58] Field of Search ..... 280/809, 811, 814, 815, 280/816, 817; 150/166; 211/70.5; 224/917; 294/147

[56] References Cited

U.S. PATENT DOCUMENTS

| | | | |
|---|---|---|---|
| D. 213,597 | 4/1969 | Joyce | D21/230 |
| D. 216,032 | 11/1969 | Howe | D21/230 |
| D. 302,717 | 8/1989 | Skedeleski et al. | D21/230 |
| D. 316,585 | 4/1991 | Skedeleski et al. | D21/230 |
| 1,595,632 | 8/1926 | Taft | 280/601 |
| 3,066,326 | 12/1962 | Collins | 280/609 X |
| 3,374,495 | 3/1968 | Joyce | D21/230 X |
| 3,424,469 | 1/1969 | Hooker | D21/230 X |
| 3,501,160 | 3/1970 | Lange | 280/609 |
| 3,506,279 | 7/1970 | Lambert | 280/604 X |
| 3,567,239 | 3/1971 | Kitterman | D21/230 X |
| 3,820,802 | 6/1974 | Davis | 280/28 X |
| 3,876,216 | 4/1975 | Wehr | 280/601 |
| 4,006,912 | 2/1977 | Perlich et al. | 280/809 |
| 4,018,454 | 4/1977 | Burkart | 280/602 |
| 4,083,572 | 4/1978 | May, Jr. | 280/816 |
| 4,180,275 | 12/1979 | Montoya | 280/609 X |
| 4,616,842 | 10/1986 | Echevin et al. | 280/602 |
| 4,799,710 | 1/1989 | Barnett | 280/809 |
| 4,830,403 | 5/1989 | Ohmari | 280/815 |
| 4,861,063 | 8/1989 | Abondance | 280/809 X |
| 4,955,314 | 9/1990 | Skedeleski et al. | 114/219 |

FOREIGN PATENT DOCUMENTS

| | | | |
|---|---|---|---|
| 0229608 | 7/1987 | European Pat. Off. | 280/809 |
| 2820683 | 11/1979 | Fed. Rep. of Germany | 280/809 |
| 3439278 | 8/1985 | Fed. Rep. of Germany | 280/814 |
| 3844085 | 7/1990 | Fed. Rep. of Germany | 280/809 |
| 587723 | 4/1958 | Italy . | |
| 97838 | 1/1940 | Sweden | 280/815 |

*Primary Examiner*—Brian L. Johnson
*Attorney, Agent, or Firm*—Sherman and Shalloway

[57] ABSTRACT

A protective device for the upturned tip of snow skis which is in the form of a cap made from a resiliently flexible, weatherproof material and which provides a cushioning surface to the tip of the ski as protection against injury to skiers who may be hit by runaway skis. The cap is preferably mounted to the ski tip by a weather resistant adhesive so as to be in place at all times. In an alternative embodiment, the cap may be provided with friction producing elements to resist inadvertent removal while allowing its interchangability between multiple skis.

15 Claims, 3 Drawing Sheets

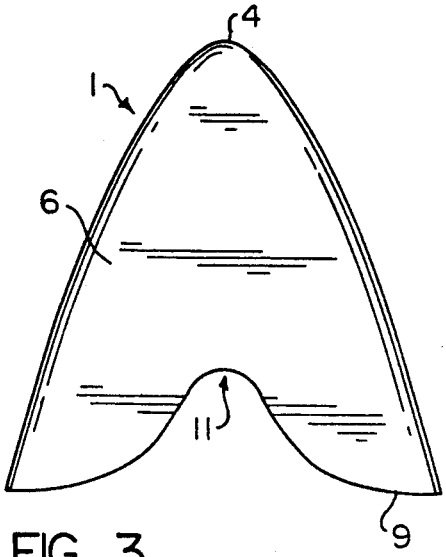
FIG. 3
FIG. 5
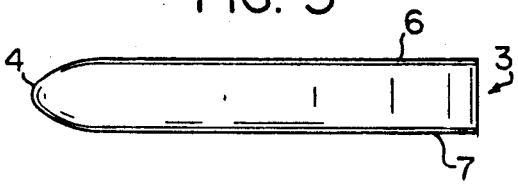
FIG. 6
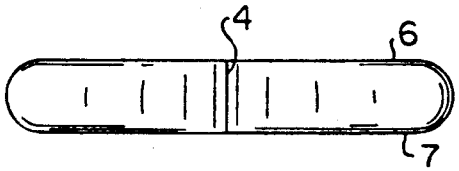
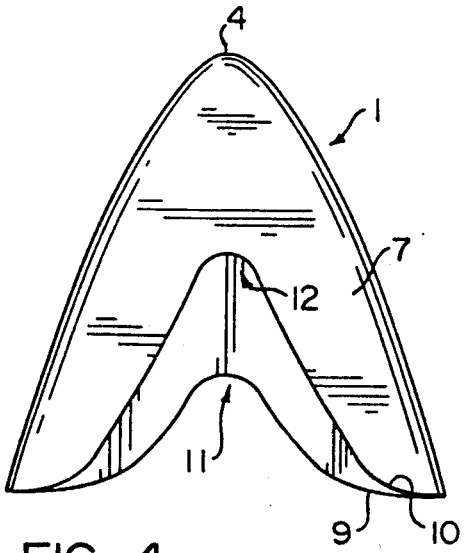
FIG. 4
FIG. 7
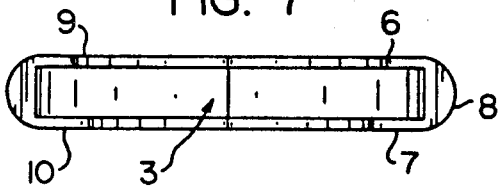

PROTECTIVE CAP FOR SKI TIPS

FIELD OF THE INVENTION

The present invention is directed toward a device for mounting on the upturned or shovel tips of snow skis as a means for providing protection to skiers should they come into contact with such ski tips. The invention also provides a level of protection to the skis themselves to prevent the tip surfaces from being marred and serves to dampen vibration of the skis and thus reduce the tendency of the ski tips to chatter. The present invention is also directed to snow skis which are protected by such protective device.

BACKGROUND OF THE INVENTION

Modern skis have sharp tips at their forward ends which can inflict injuries on skiers when fallen upon or when skiers are hit by runaway skis.

Prior devices have been proposed to provide protective means for skis to prevent marring of their surfaces as well as to reduce injuries resulting from collisions. For example, U.S. Pat. No. 3,424,469 to Hooker provides a protective strip of strong, resilient material bonded to the top edge corners of skis to prevent chipping and burring of those edges. This strip provides little or no protection against injury inflicted by the ski tip.

U.S. Pat. No. 3,876,216 to Wehr discloses a safety head to be fastened to the front end of a ski and thereby enclose the ski tip. However, the device includes a metal cap which reduces its effectiveness. Furthermore, the bulbous shape of the Wehr device hinders the flow of the ski through snow, particularly deep powder.

U.S. Pat. No. 4,083,572 to May, Jr., provides a ski tip attachment in the form of a sleeve which fits over a ski tip and has a means for mounting a light source so as to extend beyond the ski tip. The purpose of this device is to provide illumination in front of a skier, not cushioning for the ski tip. The light fixture itself presents a hazard to skiers in the event they are struck by the ski.

None of the devices of the prior art provide a simple protective means for the forward tip of the ski which provides adequate protection against injury while not interfering with the operation of the ski.

SUMMARY OF THE INVENTION

The present invention provides a protective device for mounting over the upturned forward tip of a snow ski to form a protective cushion thereon. In this manner, the risk of infliction of injury to skiers by the ski tips is significantly lessened. The device is formed as a cap of resiliently flexible, weatherproof material sized to fit over the ski tip and be retained thereon while the ski is being used by the texture of its inner surfaces or by a suitable cold weather adhesive. The cap has a smooth outer surface with no projections to interfere with a ski's performance or to present a hazard to skiers.

It is therefor an object of this invention to provide a protective cap for ski tips.

It is a further object to provide a protective cap for ski tips which prevents damage to both the ski tips and to skiers who might be struck by them.

It is a still further object to provide a protective cap for ski tips which does not interfere with the passage of the ski through snow.

Still yet another object is to provide snow skis which are protected substantially permanently by the protective cover device of this invention.

Other objects and advantages will be evident from the following drawings and descriptions and are deemed to be included herein.

BRIEF DESCRIPTION OF THE DRAWINGS

FIG. 3 is a top view of the device of the invention.

FIG. 4 is a bottom view of the device of the invention.

FIG. 5 is a side view of the device of the invention.

FIG. 6 is a front view of the device of the invention.

FIG. 7 is a rear view of the device of the invention.

DETAILED DESCRIPTION OF THE INVENTION

Figure 1:
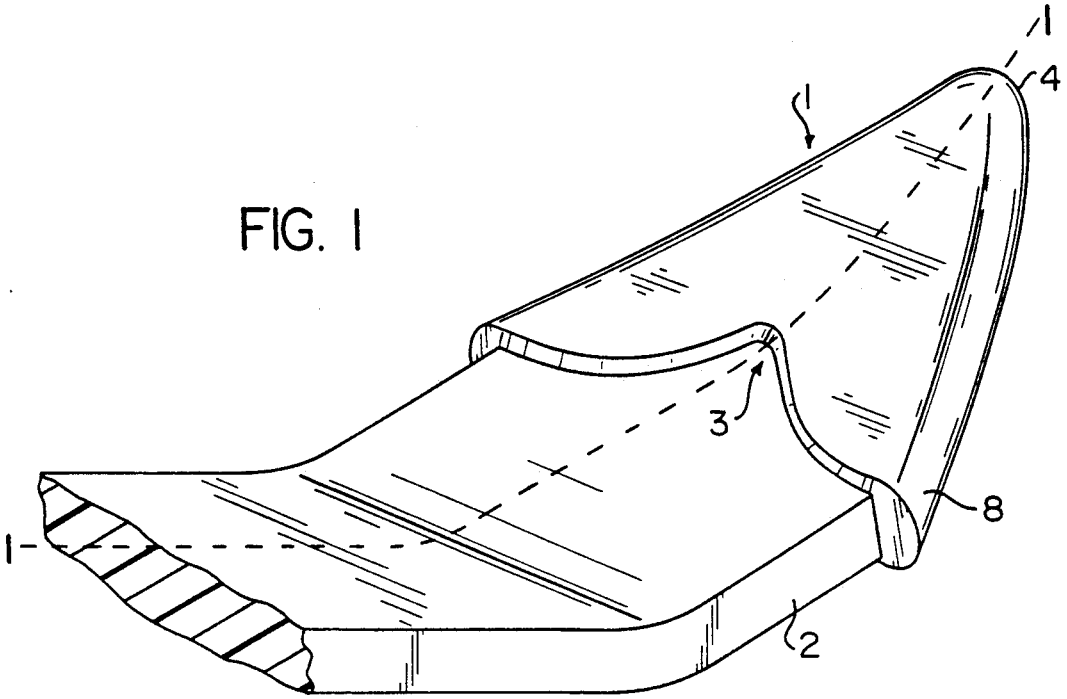
FIG. 1 is an oblique view of a ski tip with the device of the invention mounted thereon.

Looking at FIG. 1, it is seen that the protective device 1 fits over the upturned tip of a ski 2. This is further illustrated in FIG. 2 which is a longitudinal cross-section of a ski tip with the device in place. From the figures it is clear that the device 1 is in the form of a sleeve or cap having a substantially triangular shape in which one end 3 is open for insertion of the ski tip 2. The opposing apex 4 is closed and has a substantially greater thickness than the rest of the cap to provide a cushion for the generally hard and rigid end 5 of the ski tip 2. Apex 4 and the side wall 8 are generally rounded or arcuate in shape so that in case of contact with another skier the impact forces will be less severe than with a pointed tip or than with the uncovered rigid end 5 of the ski.

The cap 1 is made from a resiliently flexible, weather proof material such as natural or synthetic rubber, polyurethane, or the like having a smooth outer surface. The material from which the cap 1 is formed must retain its flexibility and resiliency even when exposed to cold temperatures and snow and ice. A preferred material is polyurethane having a durometer hardness of from 60 to 70A on the Shore hardness scale. Such a material provides sufficient rigidity while retaining the necessary resiliency to provide a level of deflective and cushioning force when struck. In addition, materials having these characteristics also tend to absorb vibration and thus provide a dampening effect during use of the skis. This feature is particularly desirable in that the protective cover device also functions as a vibration absorber.

As skis travel over snow and ice, they tend to vibrate as a result of the changing conditions and surface texture of the snow. These vibrations begin under the point where the skier's boot is fixed to the ski and run forward and rearward along the length of the ski. Since the tail, or rear end of the ski, is in relatively constant contact with the snow and most of a skier's weight is directed toward the rear end of the ski, any vibration at that point is dampened and passed out to the snow. In contrast, however, the tip of the ski is relatively unweighted and is free to flex and vibrate. This vibration can be particularly severe when passing over rough or icy snow surfaces resulting in a phenomenon known as "chatter". The cap 1 of the invention, being of a resilient material, tends to absorb some of the vibration generated in the body of the ski and thus lessens the degree of such "chatter".

Figure 2:
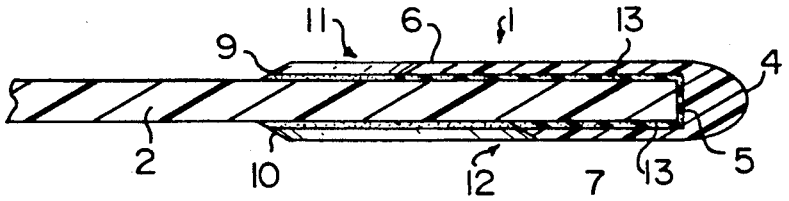
FIG. 2 is a longitudinal cross-section of the arrangement of FIG. 1 taken through line 1—1.

As noted previously, and as shown in the drawing figures, the cap 1 has a substantially triangular design to correspond to the tip of a ski and a length which is preferably no more than ½ the length of the shovel portion of the ski. The structure of the cap 1 comprises an upper wall 6 and a lower wall 7 which are parallel to each other and separated by a distance corresponding to the thickness of a ski. These walls may be slightly closer together than the normal thickness of a ski would allow thus providing a stretch fit of the cap 1 over the end of the ski 2. Upper walls 6 and 7 are separated by side wall 8 which extends around two adjoining sides of the device and across apex 4 to form the cap structure with the third side opposite apex 4 left open. Side wall 8 provides most of the cushioning effect of the device and, as such, is formed with a thickness greater than that of the upper and lower walls 6 and 7, as shown in FIG. 7. Preferably, the thickness of side wall 8 is even greater in the area of apex 4, as shown in FIG. 2, for maximum cushioning at the tip of the ski, but in any case side wall 8 should be at least twice as thick as upper and lower walls 6 and 7 which are from 1/16th to ¼th inch in thickness.

Although the primary purpose of the device of this invention is to provide a protective cushion on the tips of skis, the cap 1 also serves to protect the tip surfaces from damage and toward that end the edges 9 and 10 of the upper and lower walls 6 and 7 opposite apex 4 may be formed straight across from one side of cap 1 to the other thereby providing the maximum surface area. The ends of side wall 8 are straight. However, it is preferred that the upper and lower walls 6 and 7 be provided with longitudinally tapered cutouts 11 and 12 positioned centrally along the respective edges 9 and 10 of the walls 6 and 7. It is believed that, because these cutouts 11 and 12 taper from a wide base adjacent and substantially equal to the open end 3 of the cap toward a narrower width at their forward ends, they help to channel snow to the edges of the ski thus lessening any resistance which might be engendered by the protective cap 1 when in place on a ski. Preferably, the tapers of the cutouts 11 and 12 follow the shape and contour of the edges of the cap 1 which converge at apex 4 while their bases flare outward to the rear edges 9 and 10. It is believed that this outward flare helps to prevent the build-up of snow along the rear edges 9 and 10 of the device by directing the snow rearward and outward to the sides and edges of the ski. In the case of upper wall 6, cutout 11 should extend forward from rearmost edge 9 of upper wall 6 toward apex 4 no more than ½ the length of the device. Alternatively, cutout 12 in lower wall 7 preferably extends a distance of from ½ to ¾ the length of the device from the rearmost edge 10 of wall 7 forward toward apex 4. Thus the cutout 12 of lower wall 7 is deeper than the cutout 11 of upper wall 6. Furthermore, to provide a smooth transition between the cap 1 and the top and bottom surfaces of the ski 2, it is preferred that the rearward edges 9 and 10 of the cap 1 and the ends of side wall 8 be skived so as to taper toward the ski surfaces as shown in FIG. 2.

Mounting of the device on a ski tip is achieved by sliding the cap 1 onto the ski tip 2 by means of the open end 3. The cap is preferably held in place by a suitable adhesive 13, shown in FIG. 2, applied to the ski surfaces or to the inside surfaces of the upper wall 6, the lower wall 7 and the side wall 8. The adhesive should be weather resistant, especially waterproof, and not affected by cold temperatures. Suitable adhesives may be selected from among the ranks of epoxies, contact cements, polyester resin bonding agents and the like and preferably have some flexibility and shock absorbency even at cold temperatures.

Figure 8:
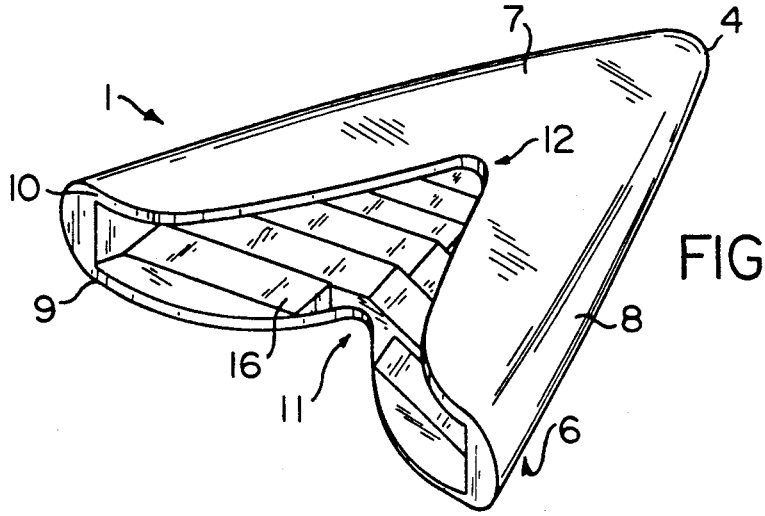
FIG. 8 is an oblique view of the device of the invention illustrating one form of molded in detent means.
Figure 9:
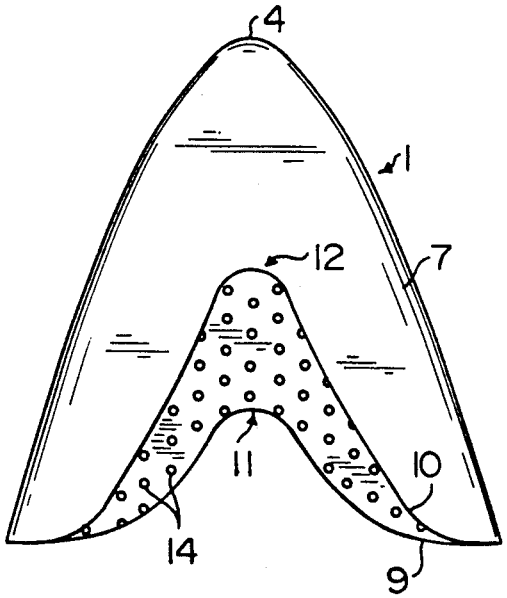
FIG. 9 is a bottom view of the device of the invention illustrating a textured inner surface.
Figure 10:
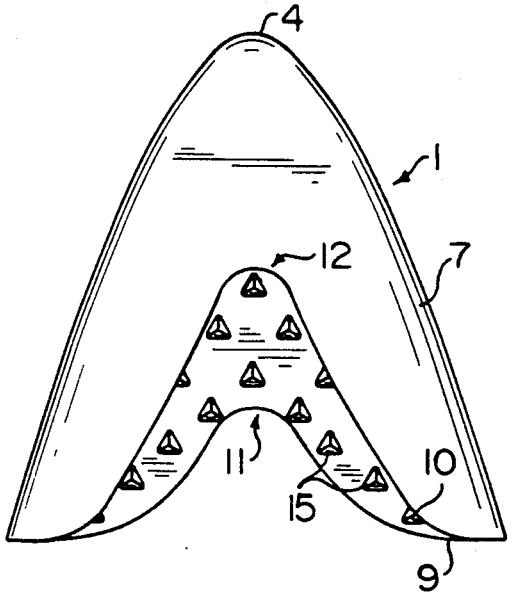
FIG. 10 is a bottom view of the device of the invention illustrating a second form of molded detent means.
Figure 11:
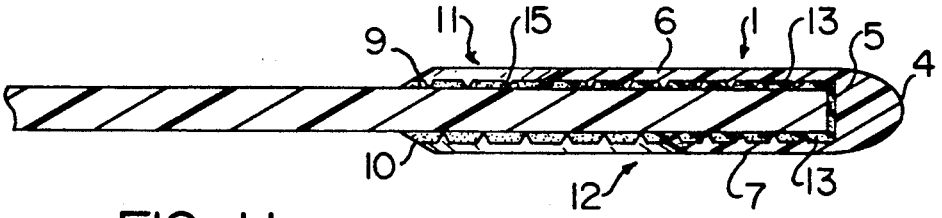
FIG. 11 is a longitudinal cross-section of the arrangement of FIG. 1 taken through line 1—1 illustrating the embodiment of FIG. 10 secured to a ski with adhesive.

In an alternative embodiment, the cap 1 may be temporarily placed on a ski so as to be removable and interchangeable between a plurality of skis. The tight fit alluded to earlier is especially preferable in this case as is the inclusion on the inner surfaces of the upper and lower walls 6 and 7 of a friction producing means which cooperates with the surfaces of the ski to resist the inadvertent or unintentional removal of the cap 1. Such friction producing means may be a rough texture or molded detents on the inner surfaces of the upper and lower walls 6 and 7 and on the inner surface of side wall 8 which will be compressed between the ski surfaces and inner surfaces of the walls. Preferred forms of such texture and detents are shown in FIGS. 8, 9 and 10. The rough texture may take any form and is molded into the inner surfaces at the time of molding of the cap 1. Particularly preferable is a texture which provides a suction surface such as a plurality of small dimples 14 formed in the inner surfaces which function in a manner similar to suction cups. In the case of molded in detents, these may take the form of substantially pyramidal shapes 15 as shown in FIG. 10 which will provide a gripping action relative to the surfaces of the skis, or laterally extending and forwardly projecting ridges 16 as shown in FIG. 8. Other shapes, such as cones, truncated cones and pyramids, rounded bumps and the like may also be used. By forming ridges 16 so that they are angled toward the apex 4, they will allow the cap 1 to be easily slid rearward onto a ski but will resist any forward motion or tendency for the cap 1 to be inadvertently pulled off. Of course, it is recognized that a cap having the textured inner surfaces may be used with an adhesive as shown in FIG. 11 to permanently mount the cap 1 to the ski 2. It is believed that the texture or molded in detents of the inner surfaces of the cap 1 may assist in the vibration dampening feature of the device by increasing the overall resiliency of the cap structure.

The device of this invention is preferably manufactured by molding means wherein the cap 1 is molded as a single unit from the appropriate material. Such material may be available and the cap 1 produced in any color desired or it may be made from transparent material.

The foregoing sets forth the preferred form of the protective device of the invention. It will be obvious to those of skill in the art that further modifications and changes may be made without departing from the spirit and scope of this invention which is limited only by the appended claims.

What is claimed is:

1. A protective cap for a snow ski having a bottom surface capable of being in contact with snow when in use, a top surface having means for attachment to a user and an upturned forward tip formed by converging edges and surfaces of said ski, said protective cap having a substantially triangular shape corresponding to said tip and comprising top, bottom and side walls formed from resiliently flexible, weatherproof material having a durometer hardness of at most 70A according to the Shore scale, said top and bottom walls each substantially triangular in shape corresponding to said ski tip and joined together by said side wall extending therebetween and around two adjoining sides thereof, said adjoining sides meeting at a common apex which is generally rounded in shape, a third side of said cap being opposite said apex and open, thereby forming a pocket within said cap between said top and bottom walls and extending to said common apex and adapted to receive said upturned tip completely therein and having centrally located, forwardly tapering cutouts in said top and bottom walls, said cutout in said bottom wall having a substantially triangular shape extending from said third side toward said apex a distance of from ½ to ¾ the length of said cap and being outwardly flared at the base thereof to a width substantially equal to said third edge adjacent to said open side and tapering to a narrow width at the forward end of said cutout substantially equivalent to the width of said rounded apex, whereby said bottom surface of said ski tip is exposed for contact with snow, and wherein said pocket has dimensions slightly smaller than said ski tip whereby said cap is stretchable for application to said ski tip and has a tight stretch fit on said ski tip.

2. The protective cap of claim 1, wherein the resiliently flexible, weatherproof material is selected from a group consisting of natural rubber, synthetic rubber and polyurethane.

3. The protective cap of claim 2, wherein said cap is adhered to a ski tip by means of a weather resistant and waterproof adhesive.

4. The protective cap of claim 3, wherein said forwardly tapering cutout in said top wall is centrally located therealong and extends toward said apex a distance of no more than ½ the length of said cap.

5. The protective cap of claim 4, wherein said top and bottom walls have a thickness of from 1/16th to ¼th inch and said side wall has a thickness at least twice as thick as said top and bottom walls.

6. A protective cap for an upturned tip of a snow ski comprising:

a top wall of substantially triangular shape having an inner textured surface and an outer substantially non-textured surface and a thickness of from 1/16th to ¼th inch;

a bottom wall of substantially triangular shape having an inner textured surface and an outer substantially non-textured surface and a thickness of from 1/16th to ¼th inch;

a side wall having a substantially flat inner and a rounded outer surface, a thickness at least twice as thick as said top and bottom walls, and joining said top and bottom walls in a spaced and parallel relationship along two adjoining edges thereof to form said cap having a pocket with a narrow rounded closed end and a wide open end for placement over said upturned tip of a snow ski; and a centrally located, forwardly tapering cutout in said bottom wall, said cutout having a substantially triangular shape extending from an edge of said bottom wall adjacent said open end toward said closed end a distance of from ⅜ to ¾ the length of said cap and being outwardly flared at the base thereof to a width substantially equal to said edge adjacent to said open end and tapering to a narrow width at the forward end of said cutout substantially equivalent to the width of said rounded closed end of said cap, whereby said bottom surface of said ski tip is exposed for contact with snow;

wherein said cap is formed from a resiliently flexible, weatherproof material, and whereby said pocket has dimensions slightly smaller than a ski tip on which said cap is placed whereby said cap has a tight stretch fit over said ski tip and provides a cushioning surface to said ski tip when affixed thereto.

7. The protective cap of claim 6, wherein edges of said top, bottom and side walls adjacent said open end are provided with a skive through the thickness of said walls from the outer surfaces to the inner surfaces thereof.

8. The protective cap of claim 7, wherein said resiliently flexible, weatherproof material is polyurethane having a durometer hardness of from 60A to 70A according to the Shore hardness scale.

9. The protective cap of claim 8, wherein said rough texture of said inner surfaces cooperates with surfaces of said ski tip to produce a resistance to the removal of said cap.

10. The protective cap of claim 9, wherein said cap further comprises weather resistant adhesive applied to at least one inner surface thereof for joining said ski tip to said cap.

11. The protective cap of claim 9, wherein said rough texture is in the form of molded-in detents compressible between the ski and the cap.

12. The protective cap of claim 11 wherein said detents comprise laterally extending and forwardly projecting ridges molded into the inner surface of at least one of said top and bottom walls.

13. The protective cap of claim 11 wherein said detents comprise a plurality of individually, inwardly projecting elements molded into the inner surfaces of said top and bottom walls.

14. In a snow ski comprising a tail, a mid section and an upturned tip, the improvement comprising a protective tip cover comprising a cap of resiliently flexible, shock absorbing, weatherproof material having a substantially triangular shape corresponding to said upturned tip and having a top wall, a bottom wall and a side wall therebetween extending around two adjoining sides thereof separating said top and bottom walls, said adjoining sides meeting at a common apex which is generally rounded in shape, said side wall having a substantially rounded outer surface, said bottom wall having a cutout of substantially triangular shape extending forward from a third side of said cap opposite said common apex for a distance of from ½ to ¾ the length of said cap and having an outward flare at said third side to said side wall tapering to a width at a forward end which is substantially equivalent to the width of said rounded common apex whereby a bottom surface of said ski tip is exposed for contact with snow, said third side of said cap being opposite said apex and open, thereby forming a pocket within said cap extending to said apex in which said upturned tip is received, wherein said resiliently flexible weatherproof material has a durometer hardness of at most 70A according to the Shore hardness scale, whereby said cap provides a cushion on said upturned tip to protect said upturned tip from marring and to avoid injury to persons struck by said upturned tip, said pocket has dimensions slightly smaller than said ski tip whereby said cap is stretchable for application to said ski tip and has a tight stretch fit on said ski tip, and inner surfaces of said pocket are provided with friction means whereby removal of said tip cover is resisted.

15. The snow ski of claim 14 wherein said protective tip cover is permanently mounted to said ski tip by means of a cold weather adhesive.

* * * * *